US009269305B2

(12) United States Patent
Hussain et al.

(10) Patent No.: US 9,269,305 B2
(45) Date of Patent: Feb. 23, 2016

(54) REDUCED BACKLIGHT TURN ON TIME

(75) Inventors: Asif Hussain, San Jose, CA (US); Manisha P. Pandya, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 565 days.

(21) Appl. No.: 13/610,067

(22) Filed: Sep. 11, 2012

(65) Prior Publication Data

US 2014/0071172 A1 Mar. 13, 2014

(51) Int. Cl.
*G09G 3/34* (2006.01)

(52) U.S. Cl.
CPC ..... *G09G 3/3406* (2013.01); *G09G 2320/0242* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 6,388,388 | B1 * | 5/2002 | Weindorf et al. | 315/169.3 |
| 2008/0303947 | A1 | 12/2008 | Ohnishi et al. | |
| 2010/0177017 | A1 | 7/2010 | Zeng et al. | |
| 2011/0221757 | A1 | 9/2011 | Hsieh | |
| 2011/0298834 | A1 | 12/2011 | Shin | |
| 2012/0050975 | A1 | 3/2012 | Garelli et al. | |
| 2013/0007301 | A1 * | 1/2013 | Jung et al. | 710/5 |
| 2013/0106836 | A1 * | 5/2013 | Kim et al. | 345/419 |

* cited by examiner

*Primary Examiner* — Amr Awad
*Assistant Examiner* — Andre Matthews
(74) *Attorney, Agent, or Firm* — Fletcher Yoder PC

(57) ABSTRACT

Systems, devices, and methods for using a hot plug detect (HPD) signal to reduce turn on time of a backlight of a display are disclosed. The backlight controller may pre-charge the backlight based at least in part on receiving the HPD signal prior to receiving a BL_EN signal to turn on the backlight. The HPD signal may be a multipurpose signal used by components of a system in addition to the backlight driver. The backlight driver may turn on the pre-charged backlight immediately upon receiving the BL_EN signal. The backlight controller may maintain the pre-charge of the backlight while the device is in a sleep state to reduce the turn on time of the backlight from the sleep state. Embodiments of the HPD signal may also power down the display and backlight.

22 Claims, 8 Drawing Sheets

REDUCED BACKLIGHT TURN ON TIME

BACKGROUND

The present disclosure relates generally to a backlight assembly for an electronic display and, more particularly, to a backlight assembly having a reduced backlight turn on time.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), commonly appear in many different electronic devices, such as televisions, computers, and phones. LCDs portray images by modulating the amount of light that passes through a liquid crystal layer within pixels of varying color. A display driver for the LCD produces images on the display by adjusting the image signal supplied to each pixel across the display. The brightness of an LCD depends on the amount of light provided by a backlight assembly. As the backlight assembly provides more light, the brightness of the LCD increases.

Backlight drivers may supply driving signals to the backlight assembly to illuminate the LCD at a desired brightness level. The backlight assembly may be turned off when images are not displayed. Light sources of the backlight assembly may take time to turn on to the desired brightness level. Unfortunately, delays in turning on the backlight may delay the appearance of images on the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to systems, devices, and methods for using a first signal to reduce turn on time of a backlight of a display. In one example, a timing controller transmits a backlight enable (BL_EN) signal to a backlight driver to indicate that the timing controller is ready to display image data on the display. The backlight controller may pre-charge the backlight based at least in part on receiving a hot plug detect (HPD) signal prior to receiving the BL_EN signal. The HPD signal may be a multipurpose signal used by components of a system in addition to the backlight driver. The timing controller may transmit multiple signals to the backlight controller. In some embodiments, the backlight controller may pre-charge the backlight based at least in part on receiving a first signal of the multiple signals from the timing controller prior to receiving the BL_EN signal. The backlight controller may pre-charge the backlight to reduce the response time between receiving the BL_EN signal and turning the backlight on. In some embodiments, the backlight driver may turn on the pre-charged backlight immediately upon receiving the BL_EN signal. The BL_EN signal may be delayed after the HPD signal or delayed relative to another signal from the timing controller, such as a VSYNC signal and/or a LSYNC signal. The backlight controller may maintain the pre-charge of the backlight while the device is in a sleep state to reduce the turn on time. The HPD signal may also power down the display and backlight.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an example," or the like, are not intended to be interpreted as excluding the existence of additional embodiments that also incorporate the recited features.

As mentioned above, embodiments of the present disclosure relate to a backlight driver that reduces the turn on time of a backlight when turning the backlight on. The backlight may be turned on from a powered down state and/or a sleep state. The backlight driver may pre-charge the backlight based on receiving a first signal (e.g., hot plug detect signal) from a timing controller rather than charging the backlight upon receiving a BL_EN signal from the timing controller. The timing controller transmits the BL_EN signal to the backlight driver to indicate that the timing controller is ready to display image data on the display. Pre-charging the backlight enables the backlight driver to turn on the backlight immediately upon receiving the BL_EN signal. This reduces the delay of turning on the backlight by at least some of the time otherwise used to charge the backlight.

Figure 1:
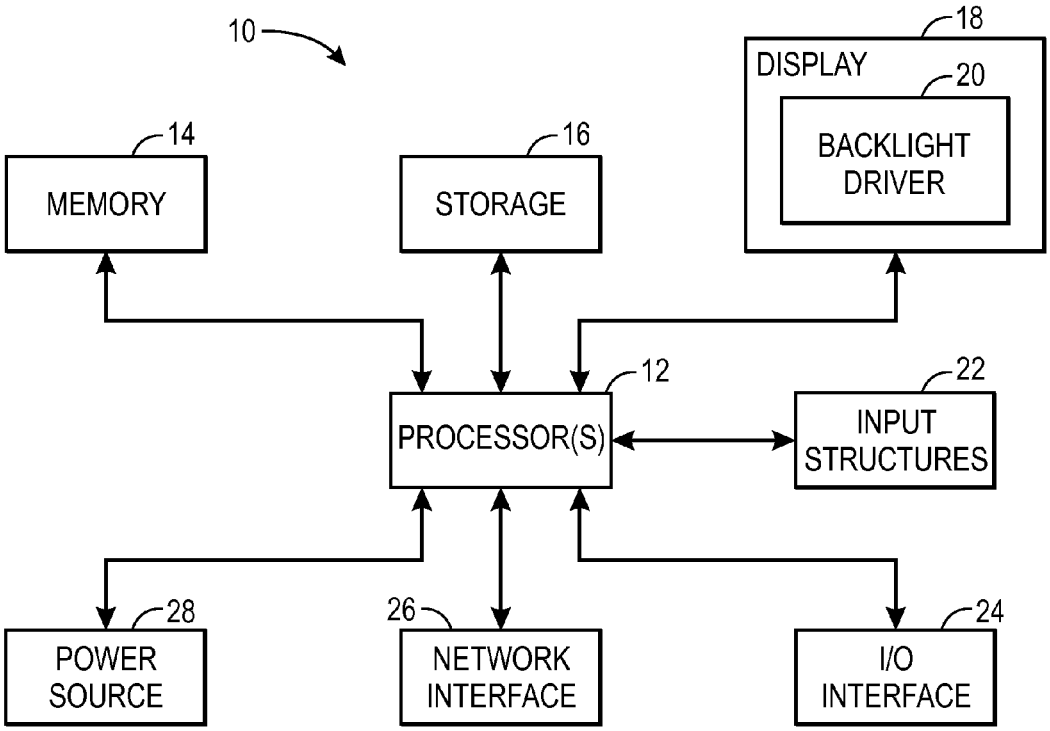
FIG. 1 is a schematic block diagram of an electronic device that incorporates a display with reduced backlight turn on time, in accordance with an embodiment.
Figure 2:
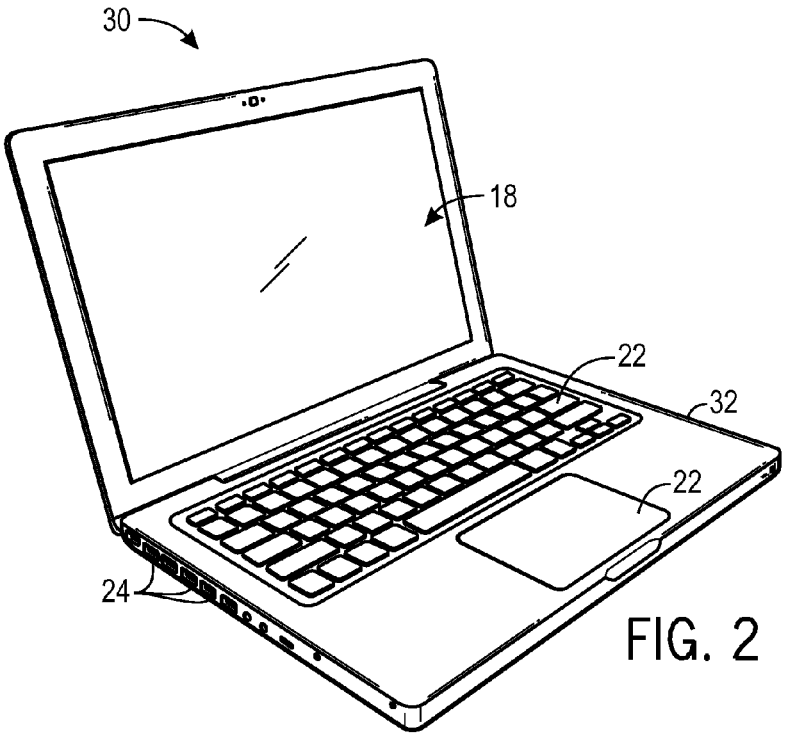
FIG. 2 is a perspective view of an example of the electronic device of FIG. 1 in the form of a notebook computer, in accordance with an embodiment.
Figure 3:
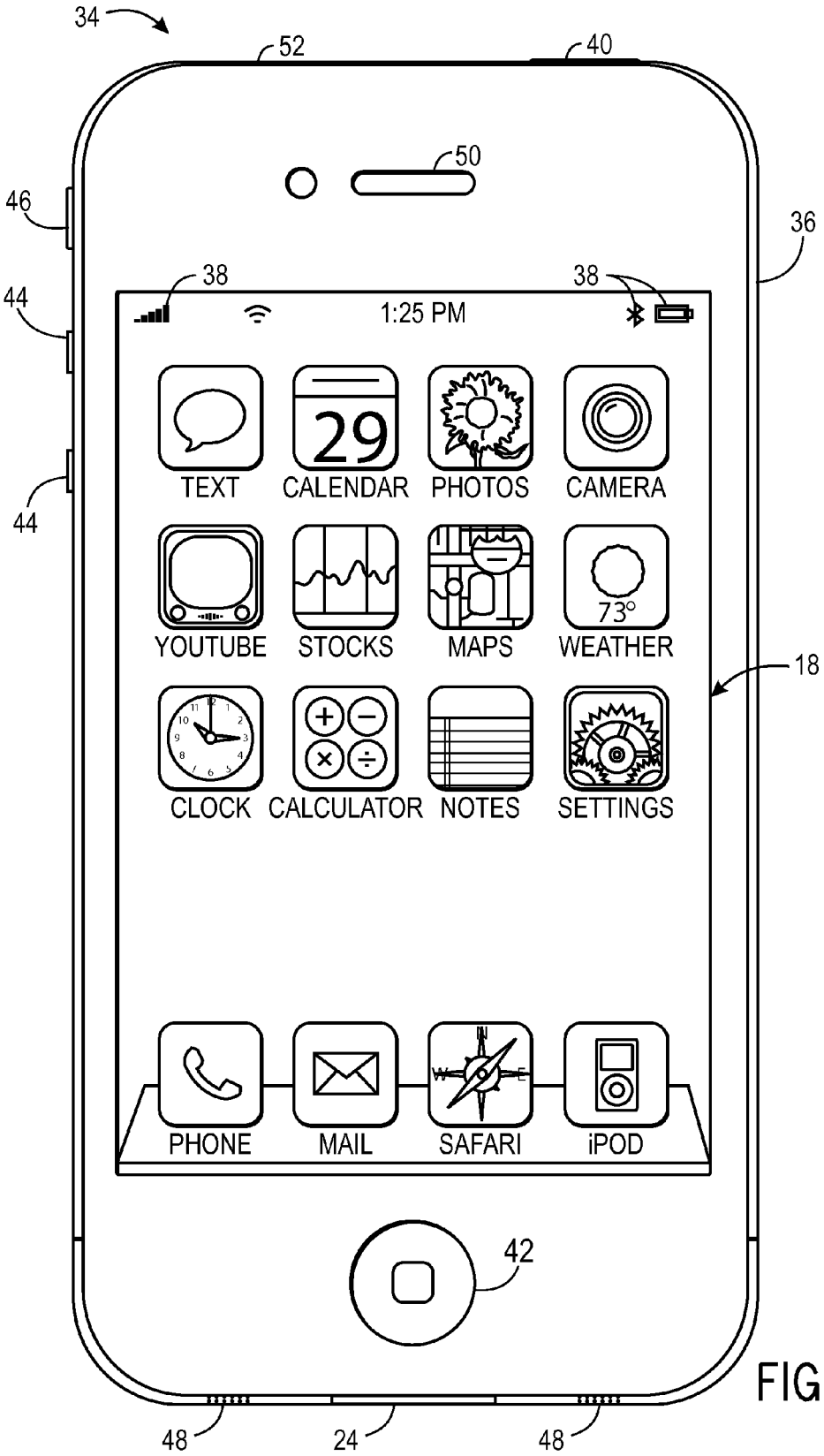
FIG. 3 is a front view of an example of the electronic device of FIG. 1 in the form of a handheld electronic device, in accordance with an embodiment.
Figure 4:
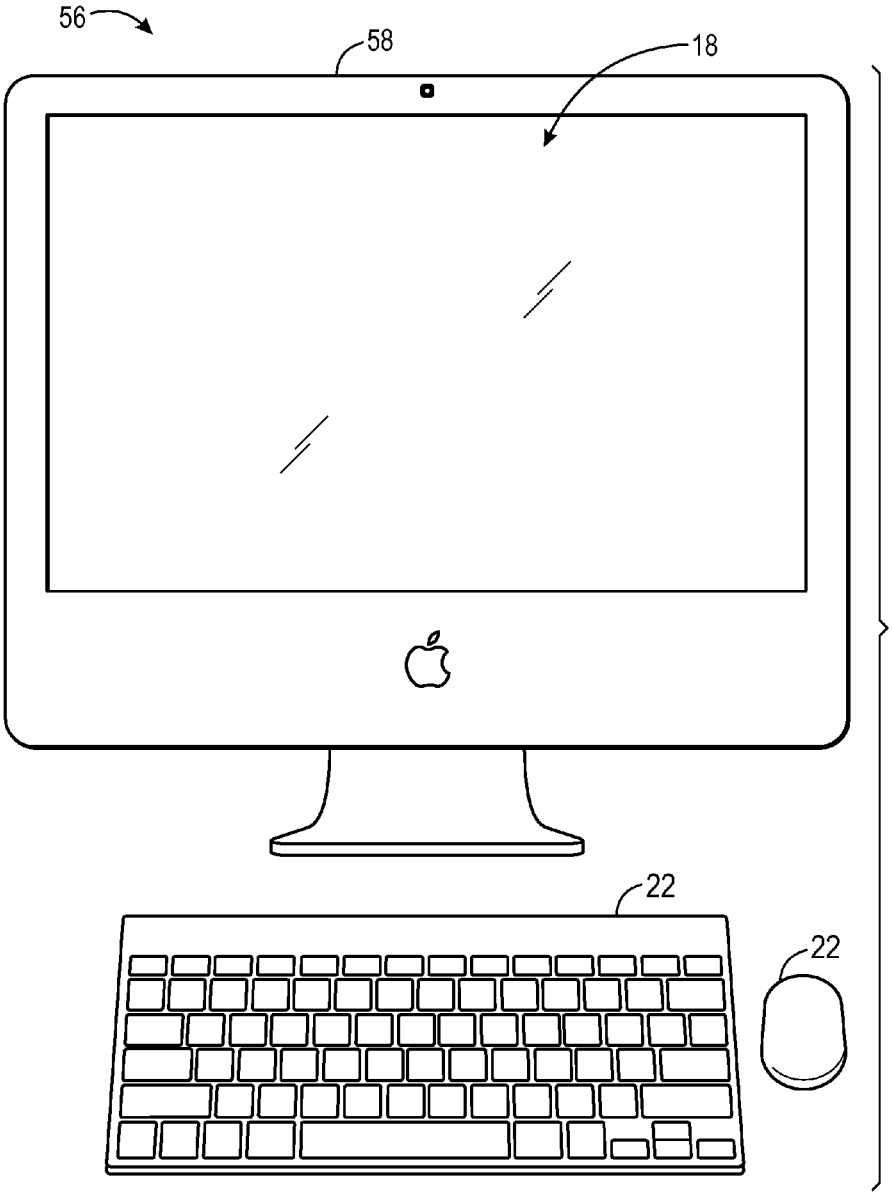
FIG. 4 is a front view of an example of the electronic device of FIG. 1 in the form of a desktop computer, in accordance with an embodiment.

With the foregoing in mind, a general description of suitable electronic devices that may employ electronic displays with reduced backlight turn on time will be provided below. In particular, FIG. 1 is a block diagram depicting various components that may be present in an electronic device suitable for use with such a display. FIGS. 2, 3, and 4 illustrate various examples of suitable electronic devices in the form of a notebook computer, a handheld electronic device, and a desktop computer, respectively.

Turning first to FIG. 1, an electronic device 10 according to an embodiment of the present disclosure may include, among other things, one or more processor(s) 12, memory 14, nonvolatile storage 16, a display 18 having a backlight driver 20, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

By way of example, the electronic device 10 may represent a block diagram of the notebook computer depicted in FIG. 2, the handheld device depicted in FIG. 3, the desktop computer depicted in FIG. 4, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile storage 16 to execute instructions to carry out various functions of the electronic device 10. Among other things, these functions may include generating image data to be displayed on the display 18. The programs or instructions executed by the processor(s) 12 may be stored in any suitable article of manufacture that includes one or more tangible, computer-readable media at least collectively storing the instructions or routines, such as the memory 14 and/or the nonvolatile storage 16. The memory 14 and the nonvolatile storage 16 may represent, for example, random-access memory, read-only memory, rewritable flash memory, hard drives, and optical discs. Also, programs (e.g., an operating system) encoded on such a computer program product may also include instructions that may be executed by the processor(s) 12 to enable other functions of the electronic device 10.

The display 18 may be a touch-screen liquid crystal display (LCD), for example, which may enable users to interact with a user interface of the electronic device 10. By way of example, the display 18 may be a MultiTouch™ display that can detect multiple touches at once. The display 18 may include the backlight driver 20 to drive a backlight to illuminate the display 18. Illuminating the display 18 may increase the visibility of the image data shown on the display 18. As discussed in detail below, a backlight enable signal (BL_EN) may be used to control the backlight driver 20 to turn the backlight on and off during routine operation of the electronic device 10. For example, the backlight driver 20 may turn off the backlight after a certain idle period of the electronic device 10 and/or upon actuation of a user input structure 22. The backlight driver 20 may turn on the backlight in response to the BL_EN signal to facilitate user input and/or to display image data to a user via the display 18. Since turning on the backlight may take time for the backlight driver 20 to charge the backlight to an appropriate voltage, embodiments of the backlight driver 20 may pre-charge the backlight based on a first signal (e.g., hot plug detect signal) received prior to the BL_EN signal. Pre-charging the backlight reduces the turn on time of the display 18, which may enable the backlight to be turned on when the backlight driver 20 receives the backlight enable signal, or shortly thereafter.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. The input structures 22, such as a keyboard and/or touchpad, may be used to interact with the computer 30. Via the input structures 22, a user may start, control, or operate a GUI or applications running on computer 30.

The display 18 of the computer 30 may be a backlit liquid crystal display (LCD). When the computer 30 includes the backlight driver 20, the backlight of the display 18 may be pre-charged based on a first signal (e.g., hot plug detect signal) received prior to receiving the BL_EN signal. The first signal may be used by the backlight driver 20 and other components of the computer 30, such that the first signal serves multiple purposes. For example, the first signal may be a hot plug detect (HPD) signal associated with connecting the display 18 or another display 18 (e.g., monitor, projector) to the computer 30. The HPD signal may be otherwise used to identify a display 18 and/or to communicate information between the display 18 and data processing circuitry. Pre-charging the backlight may reduce the wait time before a user may begin to use the display 18 by enabling the backlight of the display 18 to be turned on when the BL_EN signal is received, or shortly thereafter (e.g., within approximately 50, 30, 20, 10, or 1 ms or less).

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may turn the display 18 on or off, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones.

Like the display 18 of the computer 30, the display 18 of the handheld device 34 may be a backlit liquid crystal display (LCD). The backlight driver 20 coupled to the display 18 may reduce the turn on time of the backlight of the display 18. As mentioned above, the backlight driver 20 may reduce the turn on time of the backlight by pre-charging the backlight based on a first signal (e.g., HPD signal) received prior to a BL_EN signal.

The electronic device 10 also may take the form of a desktop computer 56, as generally illustrated in FIG. 4. In certain embodiments, the electronic device 10 in the form of the desktop computer 56 may be a model of an iMac®, Mac® mini, or Mac Pro® available from Apple Inc. The desktop computer 56 may include a housing 58, a display 18, and input structures 22, among other things. The input structures 22, such as a wireless keyboard and/or mouse, may be used to interact with the desktop computer 56. Via the input structures 22, a user may start, control, or operate a GUI or applications running on the desktop computer 56. The display 18 may be a backlit liquid crystal display (LCD). As mentioned above, the backlight driver 20 may reduce the turn on time of the backlight by pre-charging the backlight based on a first signal (e.g., HPD signal) received prior to the BL_EN signal. The first signal may be used by the backlight driver 20 and other components of the computer 30, such that the first signal serves multiple purposes. For example, the first signal may be an HPD signal associated with connecting the display 18 or another display 18 (e.g., monitor, projector) to the computer 30. Rather than charging the backlight only upon receiving the BL_EN signal and driving the backlight when fully charged, the backlight driver 20 of the display 18 pre-charges the backlight in response to a first signal to enable the backlight to be turned on upon receiving the BL_EN signal.

Regardless of whether the electronic device 10 takes the form of the computer 30 of FIG. 2, the handheld device 34 of FIG. 3, the desktop computer 56 of FIG. 4, or some other form, the display 18 of the electronic device 10 may form an array or matrix of picture elements (pixels). By varying an electric field associated with each pixel, the display 18 may control the orientation of liquid crystal disposed at each pixel. The orientation of the liquid crystal of each pixel may permit more or less light emitted from the backlight to pass through each pixel. The display 18 may employ any suitable technique to manipulate these electrical fields and/or the liquid crystals. For example, the display 18 may employ transverse electric field modes in which the liquid crystals are oriented by applying an in-plane electrical field to a layer of the liquid crystals. Examples of such techniques include in-plane switching (IPS) and/or fringe field switching (FFS) techniques.

By controlling of the orientation of the liquid crystals, the amount of light emitted by the pixels may change. Changing the amount of light emitted by the pixels will change the colors perceived by a user of the display 18. Specifically, a group of pixels may include a red pixel, a green pixel, and a blue pixel, each having a color filter of that color. By varying the orientation of the liquid crystals of different colored pixels, a variety of different colors may be perceived by a user viewing the display. It may be noted that the individual colored pixels of a group of pixels may also be referred to as unit pixels.

Figure 5:
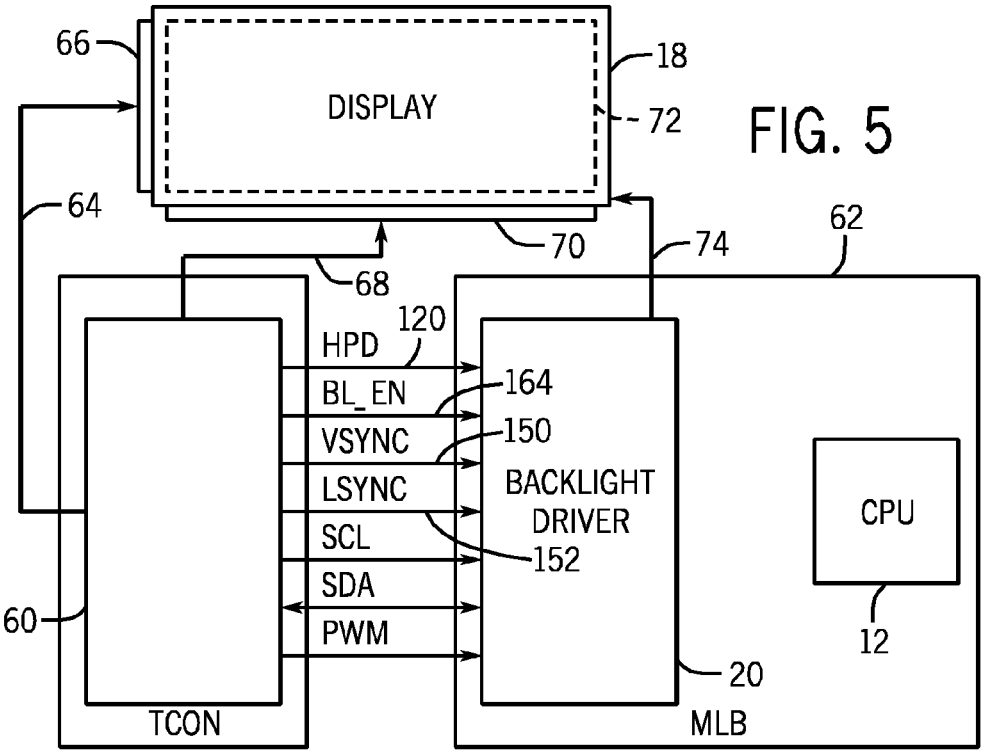
FIG. 5 is a block diagram illustrating a display coupled to a timing controller and a backlight driver on a main logic circuit board, in accordance with an embodiment.

The display panel 18 and backlight driver 20 of a presently contemplated embodiment of the electronic device 10 is shown in FIG. 5. The display 18 is coupled to a timing controller (TCON) 60 and a main logic board 62. In some embodiments, the backlight driver 20 and timing controller 60 are coupled via an inter-integrated circuit ($I^2C$) interface such that the backlight driver 20 is a slave device and the timing controller 60 is a master device. The timing controller 60 may transmit timing and column image data along a column data line 64 to one or more column drivers 66, and timing and row image data along a row data line 68 to one or more row drivers 70. These column drivers 66 and row drivers 70 may generate image signals for driving the various pixels of the display 18 based on the image data. The timing controller 60 is coupled to the backlight driver 20 of the main logic board 62.

The timing controller 60 may transmit multiple signals to the backlight driver 20, such as a hot plug detect (HPD) signal 120, a backlight enable (BL_EN) signal 164, a VSYNC signal 150, an LSYNC signal 152, a serial clock (SCL) signal, serial data signals (SDA), and pulse width modulation (PWM) signals. In some embodiments, the HPD signal 120 is used to transmit information between the display 18 and the processor 12. For example, the HPD signal 120 may be used to transmit information about the display, such as the resolution, refresh rate, display type (e.g., LCD, OLED, plasma), and so forth. In some embodiments, the HPD signal 120 may be used to indicate that a secondary display 18 is coupled to the electronic device 10. The HPD signal 120 may be transmitted to the backlight driver 20 shortly after the electronic device 10 is powered on and prior to the BL_EN signal 164. The timing controller 60 may transmit the BL_EN signal 164 to the backlight driver 20 when the timing controller 60 is ready to display image data. Upon receiving the BL_EN signal 164, the backlight controller 20 may turn on the backlight 72. In some embodiments, the timing controller 60 may transmit the HPD signal 120 after fewer operations than the BL_EN signal 164. The SCL signal may be used to synchronize the operations of the timing controller 60 and backlight driver 20. The SDA signals may transmit information between the backlight driver 20 and processing circuitry. SDA signals may represent brightness values, time durations, and other values. The VSYNC and LSYNC signals 150, 152 are supplied to the backlight driver 20 to provide frame and row data to the backlight driver 20 for tuning of the backlight 72, such as to synchronize the image data and backlight data. In some embodiments, the timing controller 60 supplies PWM signals to the backlight driver 20 to provide the backlight driver 20 with brightness values.

The backlight driver 20 is coupled to the backlight 72 via a backlight unit cable 74. The backlight driver 20 is communicatively coupled to drive the backlight 72 by controlling the signals supplied along the backlight unit cable 74. The backlight driver 20 may pre-charge the backlight in response to a first signal (HPD signal 120) so that the backlight 72 is sufficiently charged to turn on when the backlight driver 20 receives the BL_EN signal 164, or shortly thereafter.

Figure 6:
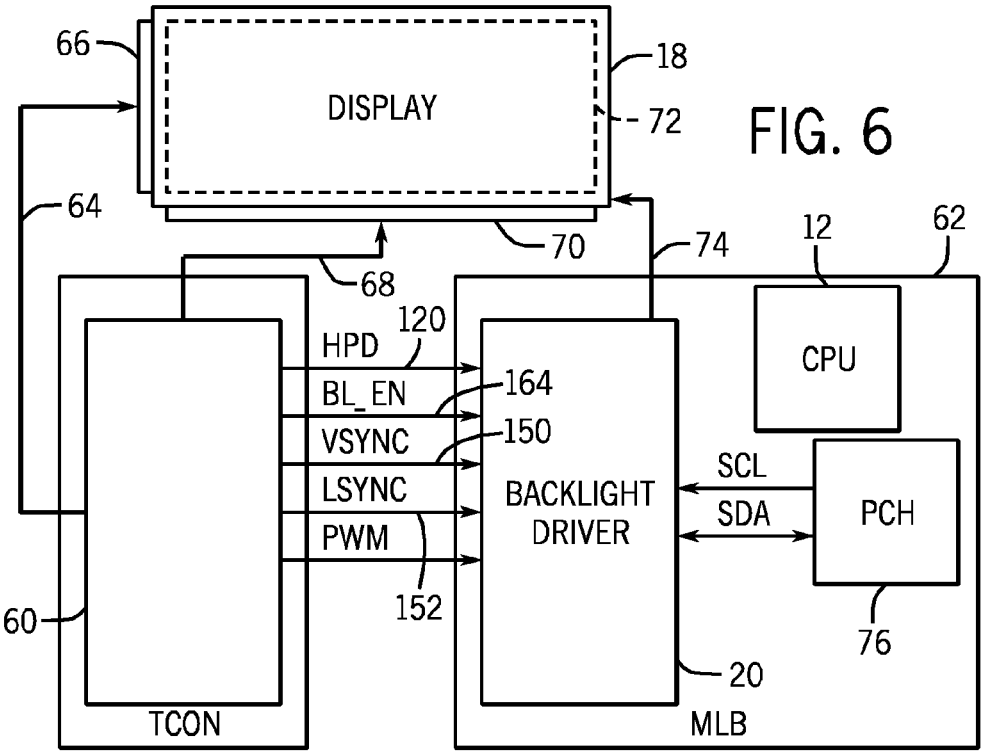
FIG. 6 is a block diagram illustrating a display coupled to a timing controller and a backlight driver on a main logic circuit board having a PCH chip, in accordance with an embodiment.

Another presently contemplated embodiment of the electronic device 10 is illustrated in FIG. 6. The embodiment shown in FIG. 6 includes a platform controller hub (PCH) 76 coupled to the processor 12, backlight driver 20, and timing controller 60 to facilitate communication between these components. This embodiment may be configured substantially similar to the embodiment of FIG. 5, except that the PCH 76 supplies the SCL and SDA signals to the backlight driver 20. This arrangement of the main logic board 62 may reduce the quantity of operations performed by the timing controller 60.

Figure 7:
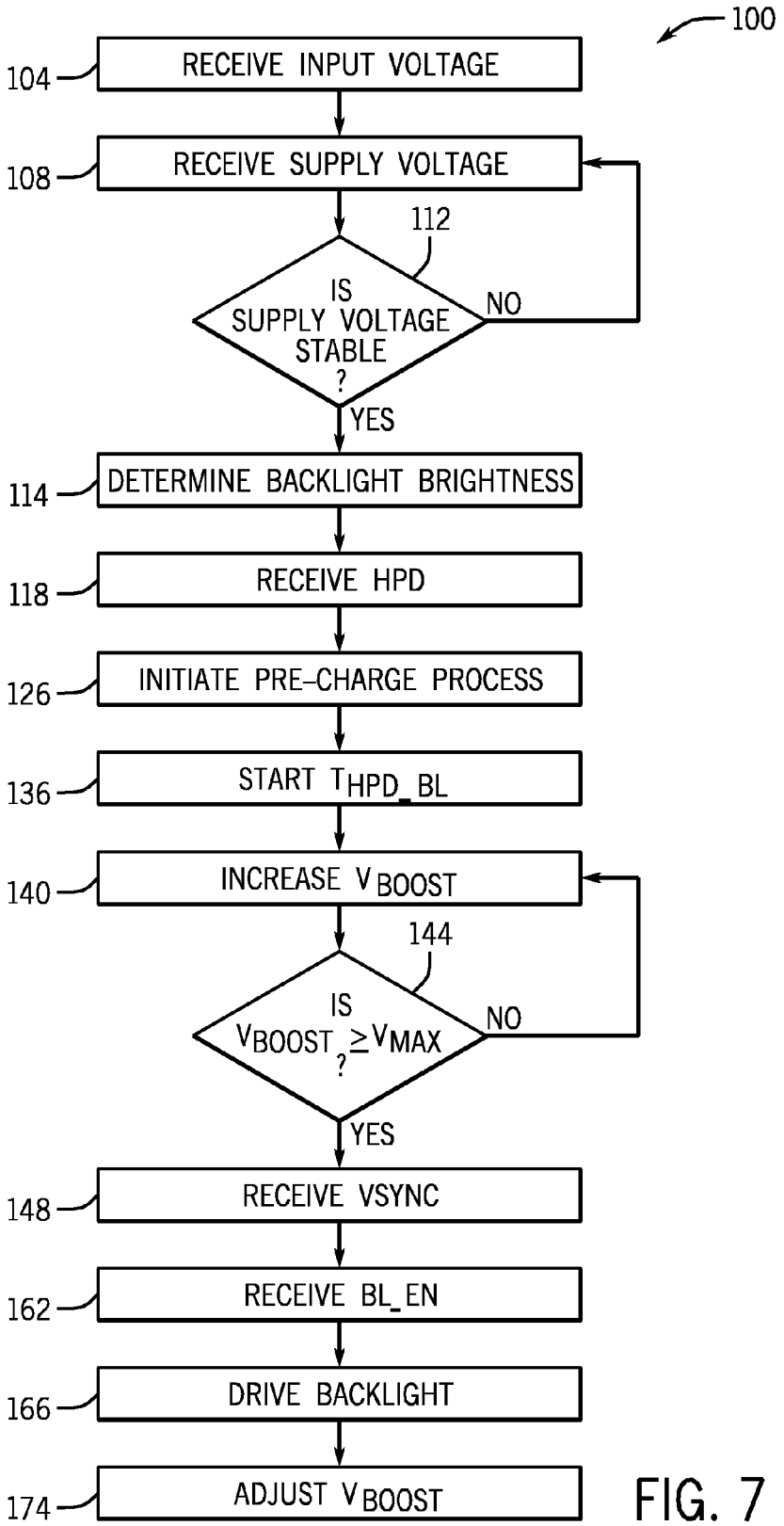
FIG. 7 is a flowchart describing a method of reducing turn on time of a backlight by using a hot plug detect signal, in accordance with an embodiment of the backlight driver of FIG. 5 or FIG. 6.
Figure 8:
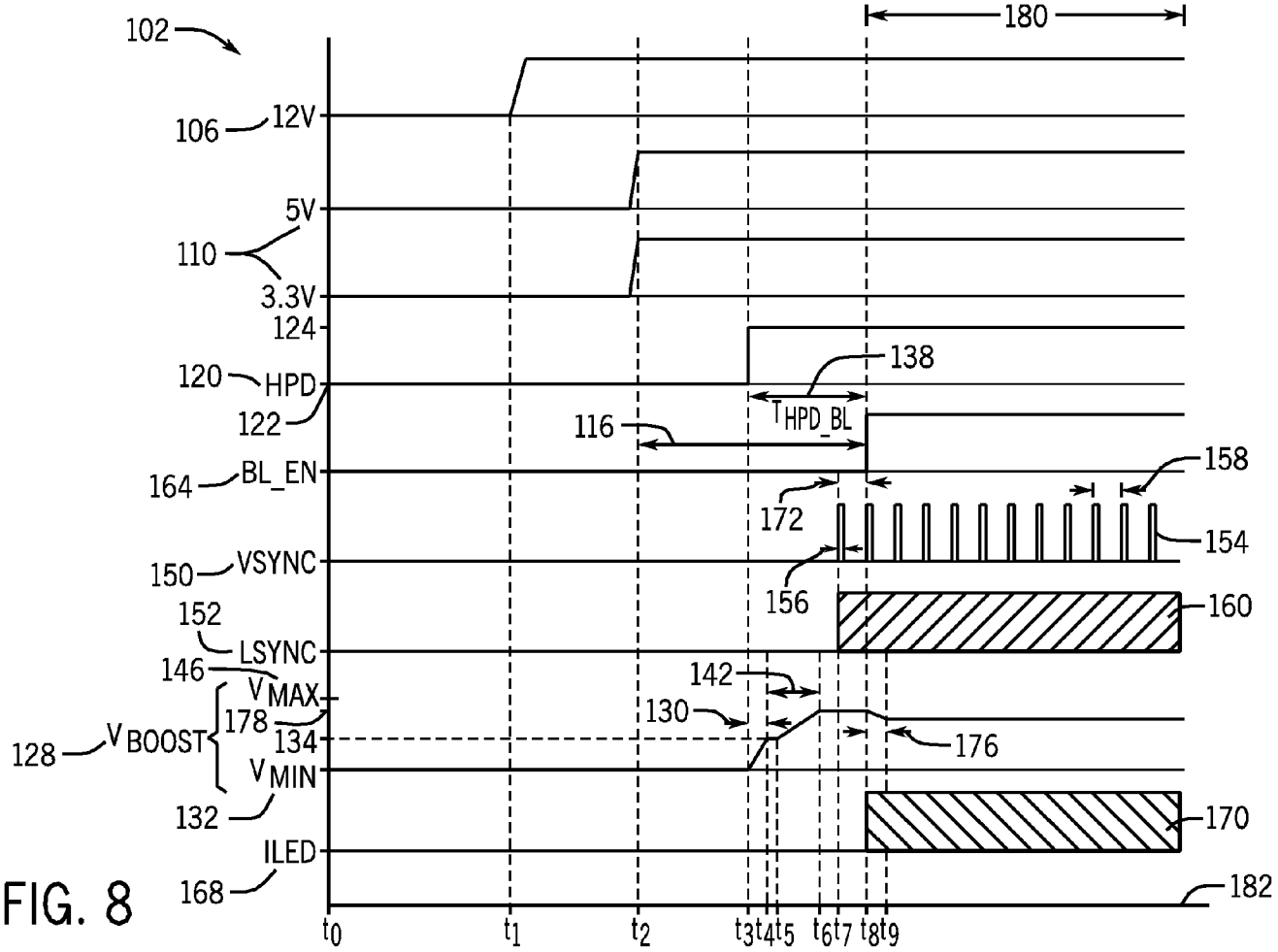
FIG. 8 is a timing diagram illustrating the timing of signals received and transmitted by the backlight driver of FIG. 5 or FIG. 6.

In some embodiments, the BL_EN signal 164 is transmitted to the backlight driver 20 at a time when the timing controller is ready to display image data and when illumination of the display 18 is desired. The backlight driver 20 may drive the backlight 72 so that the backlight 72 is turned on at substantially the same time the BL_EN signal 164 is received by the backlight driver 20. FIG. 7 illustrates a method 100 of operating the display driver 20 with a reduced turn on time of the backlight 72, and FIG. 8 illustrates a timing diagram 102 of the signals as discussed in the method 100. For clarity of discussion, FIGS. 7 and 8 are addressed together below.

At block 104, the backlight driver 20 receives input voltage 106 (e.g., 12V) from a power source 28. The diagram 102 illustrates block 104 at $t_1$ as shown by the 12V signal rising to a high 12V level from the low level at $t_0$. The electronic device 10 may step down the input voltage 106 to supply voltages 110 (e.g., 5V, 3.3V). At block 108, the backlight driver 20 receives the supply voltages 110 as shown by the 5V and 3.3V signals rising to 5V and 3.3V respectively at $t_2$. These supply voltages 110 may be used to charge and operate the backlight 72, to operate the display 18, or to operate the circuitry of the timing controller 60, the backlight driver 20, the PCH 76, and combinations thereof. At node 112, the backlight driver 20 determines whether the supply voltages 110 are stable at the maximum supply voltages (e.g., 5V and 3.3V). If the supply voltages 110 are not stable at the maximum supply voltages, then the backlight driver 20 waits and returns to block 108 until the received supply voltages 110 are stable. In some embodiments, the backlight driver 20 is to leave the backlight 72 turned off if the supply voltages 110 are unstable for a period of time (e.g., 1 ms, 10 ms, 50 ms) and/or at insufficient voltages. This may protect the backlight 72 from variations in the supply voltages 110 and/or this may conserve energy.

If the supply voltages 110 are stable, the backlight driver 20 may determine the desired backlight brightness at block 114. The brightness value may be any value between 0% (e.g., no backlight) and 100% (e.g., maximum brightness). The stable supply voltages 110 may enable the processor 12 and/or the PCH 76 to write a brightness value to memory 14 that may be read by the backlight driver 20. In some embodiments, the backlight driver 20 may determine the backlight brightness from a default brightness written in memory 14, a value (e.g., ambient light sensor measurement) communicated via the $I^2C$ interface, or a user input, or combinations thereof. The backlight driver 20, processor 12, or PCH 76 may communicate the desired backlight brightness and/or write the backlight brightness to memory 14 at any time during a standby period 116 starting at $t_2$ after the supply voltages 110 are stable.

At block 118, the backlight driver 20 receives the HPD signal 120. The timing controller 60 may transmit the HPD signal prior to the BL_EN signal 164, the VSYNC signal 150, and the LSYNC signal 152. In some embodiments, the HPD signal 120 is the first signal transmitted by the timing controller 60 after receiving the supply voltages 110. Prior to $t_3$, the HPD signal 120 is at a low level 122. At $t_3$, the timing controller 60 steps the HPD signal 120 to the high level 124. Upon detecting the high level HPD signal 120, the backlight driver 20 initiates the pre-charge process at block 126. In this way, the HPD signal 120 controls the charge applied to the backlight 72. The backlight driver 20 begins the pre-charge process at $t_3$ by increasing the $V_{boost}$ 128 of the backlight during the inrush stage 130. Prior to $t_3$, $V_{boost}$ 128 is at a low $V_{min}$ value 132 (e.g., approximately 0V). In the inrush stage 130, the backlight driver 20 increases $V_{boost}$ 128 to an intermediate voltage 134. During the inrush stage 130, the backlight driver 20 may charge one or more capacitors to the intermediate voltage 134. At block 136, a timer $T_{HPD_BL}$ 138 begins at $t_3$. The backlight driver 20, the timing controller 60, the processor 12, or the PCH 76 may monitor the timer $T_{HPD_BL}$ 138.

At block 140, the backlight driver 20 begins the boost soft start stage 142. The boost soft start stage 142 increases $V_{boost}$ 128 beyond the intermediate voltage 134. The inrush stage may end at $t_4$, and the boost soft start stage 142 increases $V_{boost}$ 128 at $t_5$. The time difference between $t_4$ and $t_5$, for example, may be less than approximately 1 ms, 500 μs, 100 μs, or 50 μs. In some embodiments, the inrush stage 130 may take between approximately 10 ms to 200 ms. As may be appreciated by one of skill in the art, the backlight driver 20 increases $V_{boost}$ 128 with a power converter (e.g., boost converter). A boost converter may increase $V_{boost}$ 128 applied to the backlight 72. At node 144, the backlight driver 20 determines whether $V_{boost}$ 128 is greater than or equal to $V_{max}$ 146. $V_{max}$ 146 may be determined to be greater than or equal to the greatest expected load voltage of the backlight 72 when the backlight 72 is turned on. The greatest expected load voltage may be greater than the loaded voltage 178. If $V_{boost}$ 128 is less than $V_{max}$ 146, then the backlight driver 20 repeats block 142 to increase $V_{boost}$ 128. The backlight driver 20 may determine $V_{max}$ 146 based on the type of light sources within the backlight 72 (e.g., light emitting diode, fluorescent), the condition of the backlight 72, the backlight brightness, the age of the backlight 72, and other factors. At $t_6$, the $V_{boost}$ 128 value is approximately equal to $V_{max}$ 146. The backlight driver 20 pre-charges the backlight 72 to $V_{max}$ 146 so that the backlight 72 may illuminate the display 18 at a desired brightness level on demand from the timing controller 60. For example, pre-charging the backlight to $V_{max}$ 146 may enable the backlight 72 to turn on at the desired brightness level rather than turning on the backlight 72 at a different brightness level. Without pre-charging the backlight 72, the backlight driver 20 then takes time to increase the brightness to the desired brightness level. The backlight driver 20 may dynamically determine $V_{max}$ 146 during operation of the display 18 to enable sufficient charge for the backlight 72 when the backlight 72 is turned on. In some embodiments, $V_{max}$ 146 is stored in memory 14.

As shown at block 148, the backlight driver 20 may receive the VSYNC signal 150 and the LSYNC signal 152 at $t_7$. The VSYNC signal 150 may be a series of pulses 154 having a pulse width 156 and a pulse period 158. In some embodiments, the pulse period 158 is between approximately 5 ms and 50 ms, 10 ms and 20 ms, or approximately 16.7 ms. Each pulse 154 may represent a frame of the data 160 the LSYNC signal 152 represents. In some embodiments, the time between $t_6$ and $t_7$ is less than or equal to approximately 100 ms, 50 ms, 10 ms, or approximately 0 ms. As discussed below, in some embodiments, the VSYNC signal may be received prior to $V_{boost}$ 128 reaching $V_{max}$ 146 at $t_6$.

At block 162, the backlight driver 20 receives the BL_EN signal 164 at $t_8$. In some embodiments, the timing controller 60 transmits the BL_EN signal 164 after $T_{HPD_BL}$ is greater than or equal to a backlight delay (e.g., $T_{BL_delay}$). The backlight delay may be stored in memory 14. The backlight delay may be based on the backlight driver 20, the duration of the inrush stage 130, and the duration of the boost soft start stage 142. For example, the bulk capacitance of the backlight driver 20 may affect the duration of the inrush stage 130. The backlight delay may be programmable to a time greater than the combined duration of the inrush stage 130 and boost soft start stage 142. For example, a backlight delay from $t_3$ to $t_8$ may be between approximately 25 ms to 500 ms, approximately 100 ms to 400 ms, or approximately 300 ms. In some embodiments, the backlight delay may facilitate the backwards compatibility of the backlight driver 20 with existing displays 18 and/or main logic boards 62.

At block 166 the backlight driver 20 may drive the backlight 72 to turn on after receiving the BL_EN signal 164. As shown in the timing diagram 102, the backlight driver 20 may supply the driving current (e.g., ILED) 168 to the backlight 72 as soon as the BL_EN signal 164 is received (e.g., at $t_8$) because $V_{boost}$ 128 is pre-charged to $V_{max}$ 146. Supplying the driving current 168 turns on the backlight 72. The backlight driver 20 supplies the driving current 168 as packets 170 designated for light sources within the backlight 72. In some embodiments, the backlight driver 20 supplies the driving current 168 to turn on the display 18 after a VSYNC period 172 of at least one pulse (e.g., frame) 154 of the VSYNC signal 150 has been received. Waiting for the VSYNC period 172 may improve the quality of the image data shown on the display 18 with the backlight 72 turned on. The VSYNC period 172 may be increased to more than one pulse 154 based at least in part on the quality of the VSYNC signal 150 and the LSYNC signal 152.

At block 174, the backlight driver 20 may adjust $V_{boost}$ 128 to match the load of the backlight 72 during an adaptive adjustment period 176. The backlight driver 20 may reduce $V_{boost}$ 128 from $V_{max}$ 146 to a loaded voltage 178 at $t_9$. The backlight driver 20 substantially maintains $V_{boost}$ 128 at the loaded voltage 178 during the operational time 180 the backlight 72 remains turned on. Driving the backlight 72 at the loaded voltage 178 rather than $V_{max}$ 146 may reduce energy consumption of the backlight 72.

The method 100 and timing diagram 102 illustrate some of the presently contemplated embodiments. The time shown along the X-axis 182 of FIG. 8 is not to scale. In some embodiments events may occur in different orders than as shown in the timing diagram 102. For example, in some embodiments, the backlight driver 20 may receive the VSYNC signal 150 (block 148, $t_7$) at any point between receiving the HPD signal 120 (block 118, $t_3$) and driving the backlight 72 (block 166, $t_8$). The backlight driver 20 may discard data from the VSYNC and the LSYNC signals 150, 152 received prior to receiving the BL_EN signal 164. In some embodiments, the timing controller 60 may transmit at least one frame (e.g., pulse 154) of the VSYNC signal 150 prior to transmitting the BL_EN signal 164 at the end of the backlight delay. For example, the timing controller 60 may transmit the VSYNC and LSYNC signals 150, 152 during the boost soft start stage 142 to enable the backlight 72 to be turned on (e.g., block 166) immediately after $V_{boost}$ 128 reaches $V_{max}$ 146. In this embodiment, the events at $t_7$ of the timing diagram 102 occur between $t_4$ and $t_6$, and $t_8$ is substantially the same at $t_6$. In some embodiments, the backlight driver 20 or timing controller 60 may monitor $T_{HPD_BL}$ and compare it to the backlight delay. The timing controller 60 may transmit the BL_EN signal 164 when $T_{HPD_BL}$ exceeds the backlight delay.

The backlight driver 20 may turn on the backlight 72 if the backlight 72 is sufficiently pre-charged (e.g., $V_{boost}$ 128$\geq V_{max}$ 146). In the event that the BL_EN signal 164, the VSYNC signal 150, or the LSYNC signal 152 is received before the backlight 72 is sufficiently pre-charged (e.g., at or after $t_3$), the backlight driver 20 waits at least until the backlight 72 is sufficiently charged (e.g., at $t_6$) before turning on the backlight 72. In some embodiments, the backlight driver 20 may initiate the pre-charging process (e.g., inrush stage 130 and boost soft start stage 142) upon receiving the HPD signal 120 rather than the BL_EN signal 164, the VSYNC signal 150, or the LSYNC signal 152. In some embodiments, the backlight driver 20 may initiate the pre-charging process upon receiving a first signal transmitted by the timing controller 60 prior to the BL_EN signal 164. The first signal may be the VSYNC signal 150, the LSYNC signal 152, the SCL signal, a certain SDA signal, or another signal. The backlight driver 20 may turn on the backlight 72 based at least in part on receiving the BL_EN signal 164. The BL_EN signal 164 may be transmitted to the backlight driver 20 based at least in part on the elapsed time since the HPD signal 120 was transmitted (e.g., $T_{HPD_BL}$) and the VSYNC and LSYNC signals 150, 152 transmitted to the backlight driver 20.

Figure 9:
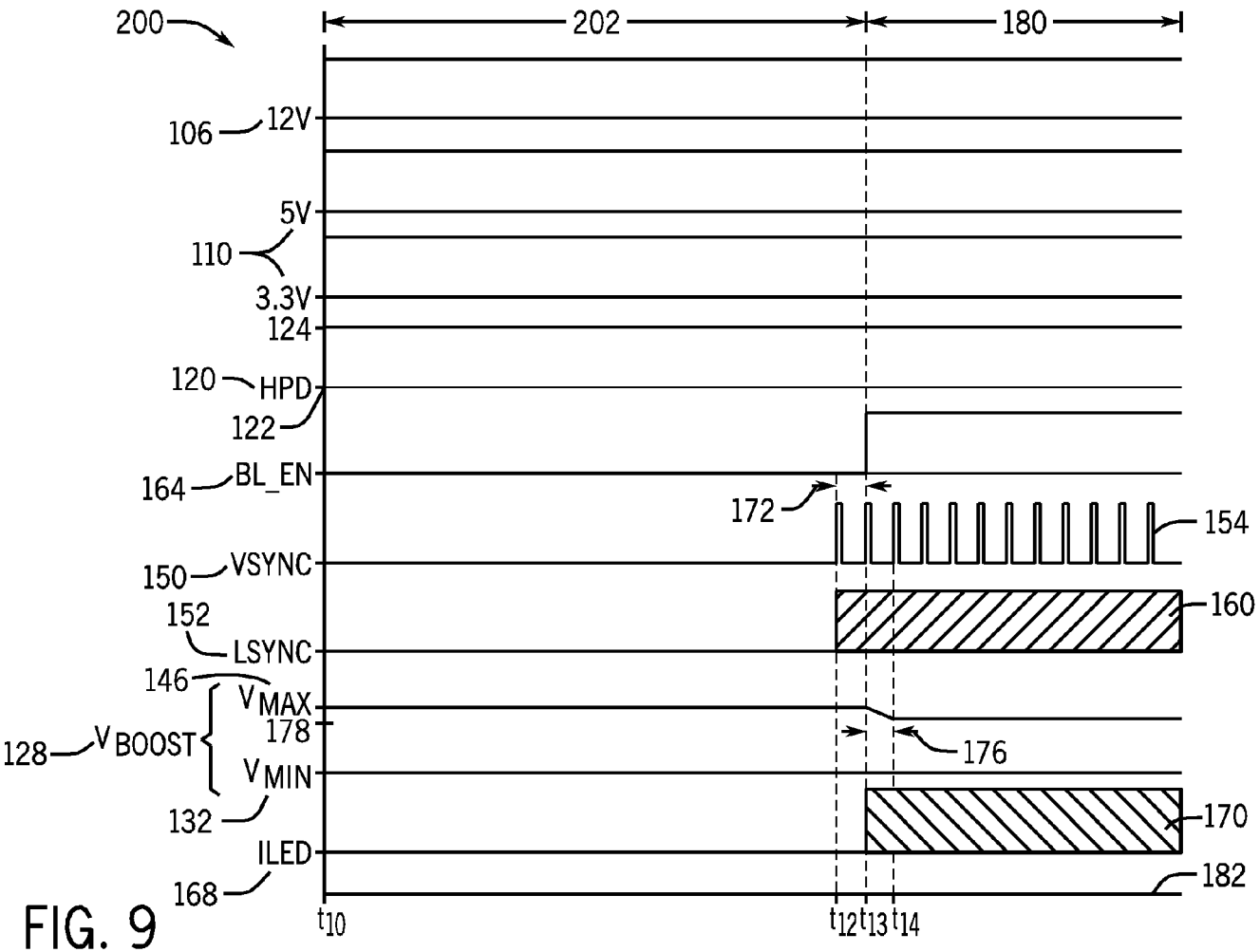
FIG. 9 is a timing diagram illustrating the timing of signals received and transmitted by the backlight driver of FIG. 5 or FIG. 6.

FIGS. 7 and 8 describe embodiments of the backlight driver 20 during a start up sequence in which the electronic device 10 is powered on from a powered off state. The electronic device 10 may have a sleep or standby state in which the display 18 is powered off, but the processor 12 and other components are powered on. The electronic device 10 may enter a sleep or standby state according to a user input and/or after a defined idle time. In some embodiments, lowering the BL_EN signal 164 while retaining the HPD signal 120 (e.g., at high logic value 124) places the display 18 in a sleep state 202. FIG. 9 illustrates a waking timing diagram 200 showing the same signals related to the backlight driver 20 discussed above with FIG. 8. The waking timing diagram 200 shows the electronic device 10 initially in the sleep state 202 at $t_{10}$. In this sleep state 202, the input voltage 106 and supply voltages 110 are at high logic values. The input voltages 106 and supply voltages 110 may power the processor 12, CPH 76, backlight driver 20, and timing controller 60 to enable the electronic device 10 to wake up rapidly from the sleep state 202. During the sleep state 202, the timing controller 60 may not transmit the VSYNC and LSYNC signals 150, 152. As discussed above, the HPD signal 120 remains at the high logic value 124 during the sleep state 202, but the BL_EN signal 164 is low. During the sleep state 202, the high HPD signal 120 retains $V_{boost}$ 128 at $V_{max}$ 146 to enable the backlight driver 20 to turn on the backlight 72 upon receiving the BL_EN signal 164.

During the sleep state 202, the HPD signal 120 may maintain $V_{boost}$ 128 substantially at $V_{max}$ 146 to enable the backlight driver 20 to turn on the backlight 72 immediately upon receiving the BL_EN signal 164. In some embodiments, the backlight driver 20 increases $V_{boost}$ 128 to ensure that it is greater than or equal to $V_{max}$ 146 and the backlight 72 is sufficiently charged. At $t_{12}$, the backlight driver 20 may receive the VSYNC signal 150 and the LSYNC signal 152. The timing controller 60 may transmit the VSYNC signal 150 and the LSYNC signal 152 after at least one frame (e.g., the VSYNC period 172) before the timing controller 60 transmits the BL_EN signal 164 at $t_{13}$. From $t_{10}$ to $t_{13}$, the backlight driver 20 is in the sleep state 202, in which the backlight driver 20 may determine the desired brightness level for the backlight 72 while waiting for the BL_EN signal 164 to turn on the backlight 72. The backlight driver 20 receives the BL_EN signal 164 at $t_{13}$, the time the timing controller 60 requests the backlight driver 20 to turn on the backlight 72. Upon receiving the BL_EN signal 164, the backlight driver 20 supplies the driving current 168 to the backlight 72 to transmit packets 170 to drive each of the light sources of the backlight 72. After turning on the backlight 72 at $t_{13}$, the backlight driver 20 may adjust $V_{boost}$ 128 to the loaded voltage 178 at $t_{14}$ that is sufficient to drive the backlight 72 at the desired level during the operational time 180 the backlight 72 remains turned on.

As discussed above with FIG. 8, the time shown along the X-axis 182 of FIG. 9 may not be to scale. The backlight driver 20 may wait for the BL_EN signal 164 for approximately 5, 10, 15, 30, 60, or 120 minutes through the sleep state 202. In some embodiments, the backlight driver 20 may wait indefinitely for the BL_EN signal 164. Alternatively, the electronic device 10 may power off after a certain period of time in the sleep state 202. The timing controller 60 may transmit the VSYNC and LSYNC signals 150, 152 at any time before $t_{13}$. The backlight driver 20 may turn on the backlight 72 upon receiving the BL_EN signal 164 and after the VSYNC period 172. Accordingly, the backlight driver 20 maintaining $V_{boost}$ 128 at $V_{max}$146 may reduce the turn on time of the backlight 72 when waking from the sleep state 202.

Figure 10:
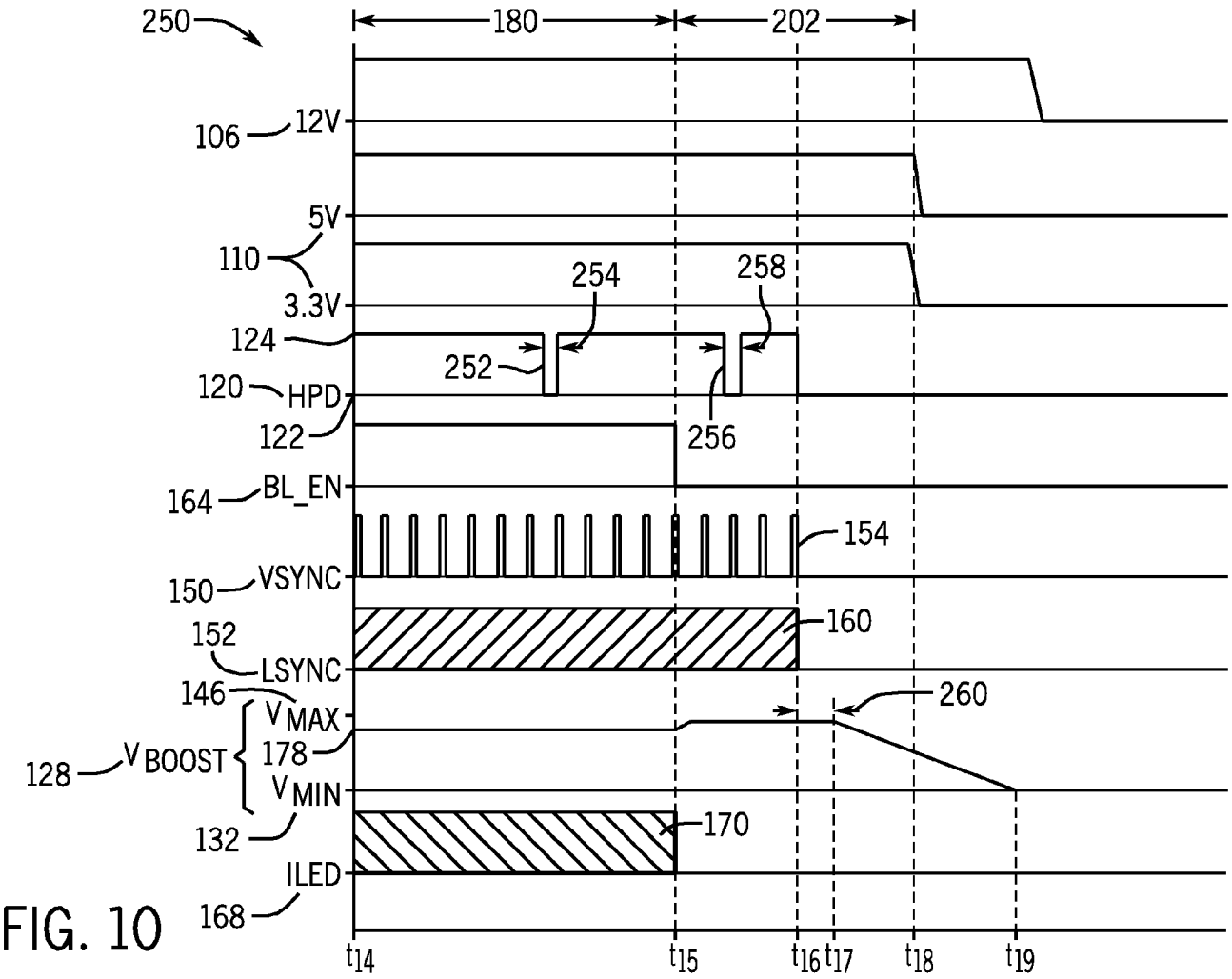
FIG. 10 is a timing diagram illustrating the timing of signals received and transmitted by the display driver of FIG. 5 and FIG. 6.

FIG. 10 illustrates a power down timing diagram 250 showing the same signals related to the backlight driver 20 as discussed above with FIGS. 8 and 9. At $t_{14}$ FIG. 10 illustrates the operational time 180 of the display 18 with the backlight driver 20 supplying the driving current 168 to keep the backlight 72 turned on to illuminate the display 18. During the operational time 180, the signals related to the backlight driver 20 (e.g., input voltage 106, supply voltages 110, HPD signal 120, BL_EN signal 164, VSYN signal 150, LSYNC signal 152, $V_{boost}$ 128, driving current 168) may have non-zero values that enable the backlight driver 20 to drive the backlight 72. The HPD signal 120 may be used by the timing controller 60, the backlight driver 20, the processor(s) 12, the CPH 76, or other components of the electronic device 10. That is, the HPD signal 120 may serve multiple purposes. For example, the backlight driver 20 may use the HPD signal 120 to initiate a pre-charge process of the backlight 72 as described above. Other components of the electronic device 10 may use the HPD signal 120 to transmit information, such as to determine when a display 18 is coupled to the electronic device 10, to identify properties of the display 18 to the processor(s) 12, or to control the display 18, or combinations thereof. The other components using the HPD signal 120 may modulate the HPD signal 120 as shown by a first downward pulse 252 with a first pulse width 254. In some embodiments, the backlight driver 20 may respond to changes of the HPD signal 120 longer than a defined power down duration (e.g., greater than approximately 0.5, 1, 2, 3, 4, 5, or 10 ms or more). The embodiment of the backlight driver 20 illustrated in FIG. 10 ignores the first downward pulse 252 because it is shorter than the power down duration. The power down duration may be a static or a dynamic value. In some embodiments, the power down duration may be stored in memory 14.

During the operational time 180 the timing controller 60 may direct the backlight 72 to turn off at $t_{15}$ by decreasing the BL_EN signal 164 to the low logic level. The backlight driver loses the BL_EN signal 164 at $t_{15}$. Upon detection of the low BL_EN signal 164, the backlight driver 20 stops supplying the driving current 168 to turn off the backlight 72. The backlight driver 20 may enter the sleep state 202 when the BL_EN signal 164 is low, yet the input voltage 106, supply voltages 110, and HPD signal 120 are high. During the sleep state 202, the backlight driver 20 may determine the desired backlight level as discussed above. As discussed above with FIG. 9, during the sleep state 202, the backlight driver 20 may maintain $V_{boost}$ 128 at the load voltage 178 or at $V_{max}$ 146 so that the backlight 72 may be turned on rapidly if the timing controller 60 transmits a high value BL_EN signal 164. The backlight driver 20 may maintain $V_{boost}$ 128 at a particular voltage based at least in part on a desired brightness level of the backlight 72 when it is turned on. The backlight driver 20 may continue to receive the VSYNC and LSYNC signals 150, 152 during part of the sleep state 202. In some embodiments, components of the electronic device 10 may modulate the HPD signal 120 during the sleep state 202, as shown by a second downward pulse 256 with a second pulse width 258. As stated above, the backlight driver 20 may respond to changes of the HPD signal 120 longer than the power down duration (e.g., greater than approximately 0.5, 1, 2, 3, 4, 5, or 10 ms or more). Accordingly, the illustrated embodiment of the backlight driver 20 ignores the second downward pulse 256 because it is shorter than the power down duration.

To power down the backlight driver 20 the timing controller 60 may lower the HPD signal 120 to the low logic value 122 for durations longer than the power down duration. In some embodiments, the HPD signal 120 may also be used to power down the electronic device 10. As shown in FIG. 10, the timing controller 60 lowers the HPD signal 120 at $t_{16}$, and the HPD signal 120 remains at the low logic value 122 until $t_{17}$. In the embodiment illustrated in FIG. 10, the difference 260 between $t_{16}$ and $t_{17}$ (e.g., 2 ms) is greater than the power down duration. Upon detection of the low HPD signal 120 longer than the power down duration, the backlight driver 20 may decrease $V_{boost}$ 128 to $V_{min}$ 132. For example, the backlight driver 20 may discharge any bulk capacitors and switch off any boost converters. The timing controller 60 may decrease the BL_EN signal 164 prior to, or within the difference 260, of lowering the HPD signal 120 longer than the power down duration. At $t_{18}$, the supply voltages 110 decrease to their respective minimum values, powering down the backlight driver 20. The VSYNC signal 150 and the LSYNC signal 152 may stop at or before $t_{18}$. At $t_{19}$, the input voltage 106 decreases to the minimum value to power down the electronic device 10.

The system and methods above describe embodiments of the display 18 and backlight driver 20. The embodiments of the backlight driver 20 may reduce the turn on time of the backlight 72 from a powered down state and/or sleep state 202 by pre-charging the backlight 72 to a voltage level (e.g., $V_{max}$ 146) prior to receiving a signal from the timing controller 60 to turn on the backlight 72. The timing controller 60 transmits the BL_EN signal 164 to the backlight driver 20 to indicate that the timing controller 60 is ready to display the image data on the display 18. At least some of the embodiments enable the backlight 72 to be pre-charged based on the HPD signal 120 so that the backlight 72 may be sufficiently charged and the backlight 72 may be turned on immediately upon receiving the BL_EN signal 164. In other embodiments, the VSYNC signal 150, the LSYNC 152, or other signals transmitted prior to the BL_EN signal 164 may be used to initiate the pre-charging of the backlight 72. In some embodiments, the timing controller 60 may transmit the BL_EN signal 164 after a backlight delay ($T_{BL_delay}$) from transmitting the HPD signal 120 and/or one or more frames (e.g., VSYNC period 172) after transmitting the VSYNC signal 150. While the electronic device 10 is in a sleep state 202, the backlight driver 20 may maintain $V_{boost}$ 128 at a determined $V_{max}$ 146 value to enable the backlight 72 to be turned on rapidly from the sleep state 202.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display, comprising:

a display panel configured to display image data;

a timing controller configured to transmit the image data to the display panel;

a backlight comprising one or more light sources; and a backlight driver configured to receive a hot plug detect signal from the timing controller, to initiate a pre-charge process that includes charging the backlight to an expected load voltage prior to receiving a backlight enabling signal of the one or more light sources based at least in part on the hot plug detect signal, and to turn on the one or more light sources substantially immediately upon receiving a backlight enable signal from the timing controller, wherein the pre-charge process is initiated prior to receiving the backlight enable signal.

2. The electronic display of claim 1, wherein the hot plug detect signal comprises a multipurpose signal received by the backlight driver.

3. The electronic display of claim 1, wherein the pre-charge process is completed prior to receiving the backlight enable signal.

4. The electronic display of claim 1, wherein the timing controller is configured to transmit the backlight enable signal after transmitting at least some image data to the backlight driver.

5. The electronic display of claim 1, wherein the backlight driver initiates the pre-charge via an inrush stage and a boost soft start stage.

6. A system, comprising: processing circuitry configured to transmit image data signals; and a display, comprising:

a backlight; and a backlight driver configured to receive a hot plug detect signal and a backlight enable signal, wherein the hot plug detect signal is configured to cause initiation of a pre-charge process that includes charging the backlight to an expected load voltage of the backlight prior to receiving the backlight enable signal, the backlight driver is configured to turn on the backlight based at least in part on receiving the backlight enable signal, and the backlight driver is configured to power off the backlight based at least in part on loss of the backlight enable signal.

7. The system of claim 6, wherein the processing circuitry is configured to receive the hot plug detect signal, the hot plug detect signal represents display data by one or more pulses, and the processing circuitry is configured to control the display based at least in part on the display data.

8. The system of claim 7, wherein the backlight driver is configured to discharge the backlight in response to a loss of the hot plug detect signal greater than or equal to a power down duration, and wherein the one or more pulses are less than the power down duration.

9. The system of claim 6, wherein the backlight driver is configured to place the display in a sleep state based at least in part upon loss of the backlight enable signal and retention of the hot plug detect signal, wherein the backlight is turned off during the sleep state, and the backlight is charged to an expected load voltage.

10. The system of claim 6, comprising a memory configured to store display data, a desired brightness level, an expected load voltage, or a backlight delay, or any combination thereof.

11. A method for operating a backlight driver to drive a backlight, comprising: receiving an input voltage;

receiving a first signal, wherein the first signal is a hot-plug detect signal;

pre-charging the backlight to an expected load voltage only based upon receiving the first signal;

receiving a backlight enable signal after receiving the first signal; and turning on the backlight upon receiving the backlight enable signal and after the backlight is pre-charged to the expected load voltage.

12. The method of claim 11, wherein the first signal comprises a multipurpose signal of an electronic display.

13. The method of claim 11, comprising receiving a VSYNC signal, wherein the VSYNC signal comprises a plurality of frames and at least one frame of the plurality of frames is received prior to receiving the backlight enable signal.

14. The method of claim 11, wherein the backlight enable signal is received once a programmable backlight delay elapses after receiving the first signal.

15. The method of claim 11, wherein pre-charging the backlight comprises charging a capacitor and switching a boost converter to boost a voltage applied to the backlight to at least the expected load voltage.

16. The method of claim 11, comprising adjusting a voltage of the backlight to a loaded voltage less than the expected load voltage after turning on the backlight.

17. An article of manufacture comprising:

one or more non-transitory, machine-readable media, at least collectively comprising instructions configured to be executed by a processor of a backlight driver, the instructions comprising instructions to:

initiate a pre-charge process of a backlight upon receiving a hot plug detect signal;

determine an expected load voltage of the backlight;

pre-charge the backlight to at least the expected load voltage; and turn on the backlight substantially immediately upon receiving a backlight enable signal after the backlight is pre-charged to the expected load voltage.

18. The article of manufacture of claim 17, comprising instructions to:

start a timer upon receiving the hot plug detect signal;

compare a value of the timer to a backlight delay; and turn on the backlight only after the value of the timer exceeds the backlight delay and the backlight enable signal has been received.

19. The article of manufacture of claim 17, comprising instructions to turn off the backlight upon loss of the backlight enable signal.

20. The article of manufacture of claim 17, comprising instruction to power down the backlight driver upon loss of the hot plug detect signal for a duration greater than or equal to a power down duration.

21. A method for operating a backlight driver to drive a backlight of an electronic device, comprising:

receiving a supply voltage and a hot plug detect signal while the electronic device is in a sleep state;

determining a desired brightness level of the backlight while maintaining a charge of the backlight at an expected load voltage based at least in part on the desired brightness level and the hot plug detect signal, wherein the expected load voltage is maintained prior to receiving the backlight enable signal; and turning on the backlight to the desired brightness level substantially immediately upon receiving the backlight enable signal.

22. The method of claim 21, comprising adjusting a voltage of the backlight to a loaded voltage less than the expected load voltage after turning on the backlight.

* * * * *